US006100803A

United States Patent [19]

Chang

[11] Patent Number: 6,100,803

[45] Date of Patent: Aug. 8, 2000

[54] INFRARED ILLUMINATIVE WARNING DETECTOR

[76] Inventor: Wen-Hsiang Chang, No. 1, Alley 36, Lane 121, Te-Lin Rd., Lung-Tan Hsiang, T'ao-Yuang Hsien, Taiwan

[21] Appl. No.: 09/247,624

[22] Filed: Feb. 10, 1999

[51] Int. Cl.[7] ..... G08B 13/18

[52] U.S. Cl. ..... 340/567; 340/693.5; 340/693.6; 340/693.9; 362/276; 250/221

[58] Field of Search ..... 340/567, 556, 340/557, 600, 693.5, 693.6, 693.9; 362/276; 359/741, 742; 446/484; 250/221

[56] References Cited

U.S. PATENT DOCUMENTS

| | | | |
|---|---|---|---|
| 5,299,971 | 4/1994 | Hart | 446/484 |
| 5,381,323 | 1/1995 | Osteen et al. | 362/276 |
| 5,489,891 | 2/1996 | Diong et al. | 340/567 |
| 5,532,680 | 7/1996 | Ousborne | 340/567 |
| 5,662,411 | 9/1997 | Haslam et al. | 362/276 |
| 5,717,203 | 2/1998 | Yung | 250/221 |
| 5,945,925 | 8/1999 | Budnovitch | 340/932.2 |

*Primary Examiner*—Benjamin C. Lee
*Attorney, Agent, or Firm*—Dougherty & Troxell

[57] ABSTRACT

An infrared illuminative warning detector including a base seat formed with at least four perforations for two light shades and two detector heads to insert in. A bulb is installed in each light shade. An infrared detector is disposed in each detector head for detecting alien article within a detection range and lighting up the bulb. Each light shade and detector head is disposed with at least one shifting mechanism for freely changing operation position. The light shades and the detector heads on the base seat are able to detect in different directions at the same time to provide a warning and illumination function in the case of intrusion of alien article.

8 Claims, 9 Drawing Sheets

INFRARED ILLUMINATIVE WARNING DETECTOR

BACKGROUND OF THE INVENTION

The present invention relates to an infrared illuminative warning detector including at least two light shades and two detector heads which are freely adjustable in direction so as to at the same time detect in different directions.

A conventional simple type sensor must be mounted with the wire laid one by one. The structure of the detector is fixed and a Y-shaped forked cylinder is disposed on a base tray in which a bulb and a detector are disposed. In use, the Y-shaped cylinder is fixedly directed so that the detection range is limited. Moreover, the installation must be performed by a specialist. The applicant has developed an improved detector as shown in FIG. 1. The detector head and a light shade are connected to form a rotary seat with a fork pattern. The rotary seat is formed with an insertion socket in which a ball post of the base seat is inserted to form a universal joint. One end of the base seat is disposed with a base tray having an electric connector for directly screwing into a common bulb seat. Therefore, a user can easily directly install the detector without laying the wire. In use, the rotary seat can be adjusted to change the detection direction. However, such structure is only applicable to some specific sites and the function thereof is still limited. As shown in FIG. 1, the detector can only detect a downward stairway in a specific direction. In the case that an unauthorized person intrudes upstairs, such detector can hardly properly react. Therefore, a dead corner exists in the detection range.

SUMMARY OF THE INVENTION

It is a primary object of the present invention to provide an infrared illuminative warning detector which is able to at the same time detect in at least two different directions.

It is a farther object of the present invention to provide the above infrared illuminative warning detector in which the light shades and detector heads are independently freely adjustable in direction.

According to the above objects, the detector of the present invention includes a base seat formed with at least four perforations for two light shades and two detector heads to insert in. A bulb is installed in each light shade. An infrared detector is disposed in each detector head for detecting alien article within a detection range and lighting up the bulb. Each light shade and detector head is disposed with at least one shifting mechanism for freely changing operation position. The light shades and the detector heads on the base seat are able to detect in different directions at the same time to provide a warning and illumination function in the case of intrusion of alien article. In a simple type detector of the present invention, the electric connector of the base seat is directly screwed into the bulb seat for obtaining power. A variable resistor is used to adjust and set up the activation time. In an enhanced type detector, a remote circuit and and an alarm are added to the detector to expand the function thereof and enable a user to set up and disarm the alarm by remote control.

The present invention can be best understood through the following description and accompanying drawings, wherein:

DETAILED DESCRIPTION OF THE PREFERRED EMBODIMENTS

Figure 1:
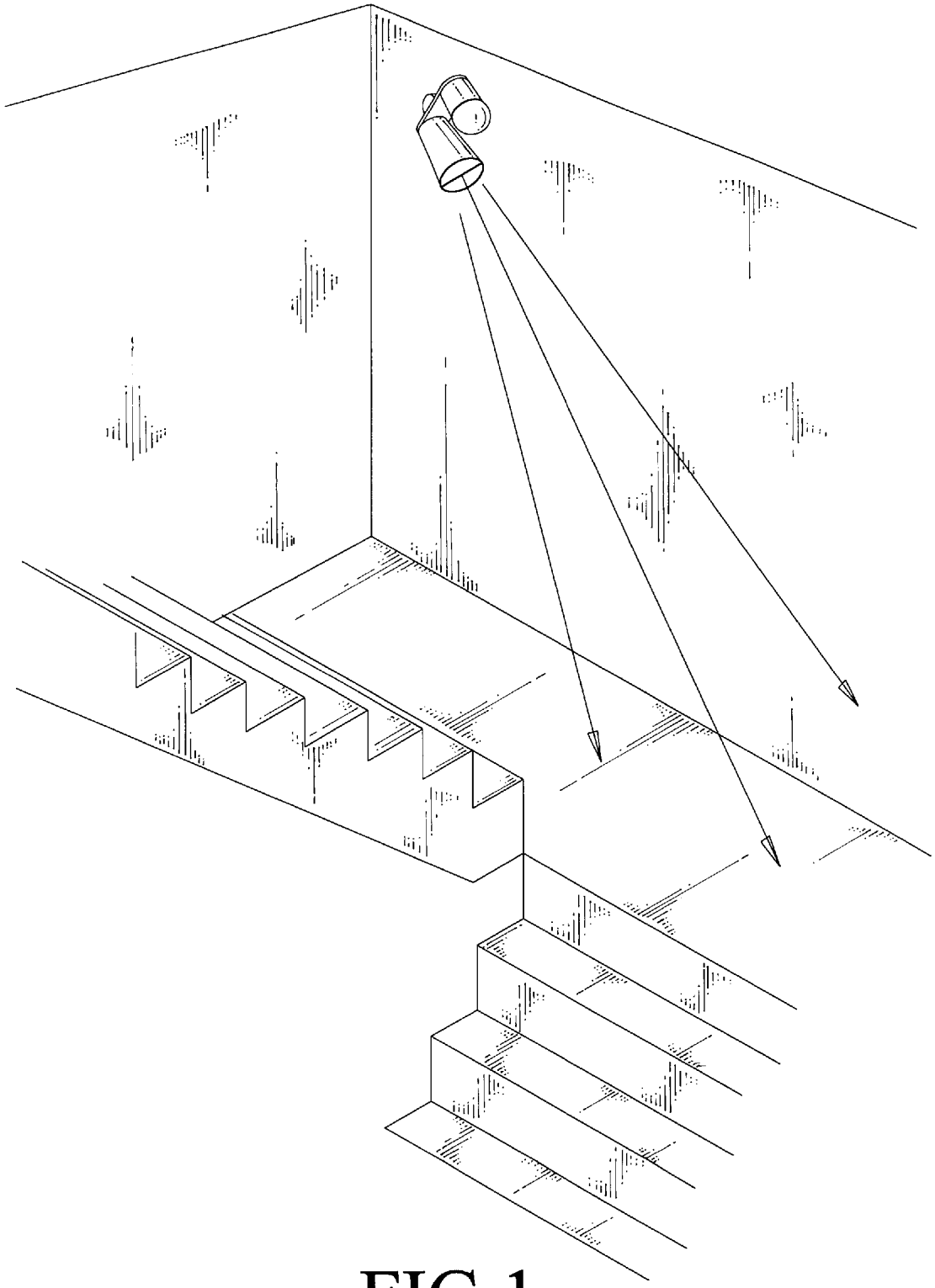
FIG.1 PRIOR ART
FIG. 1 shows the application of a prior detector of the applicant.
Figure 2:
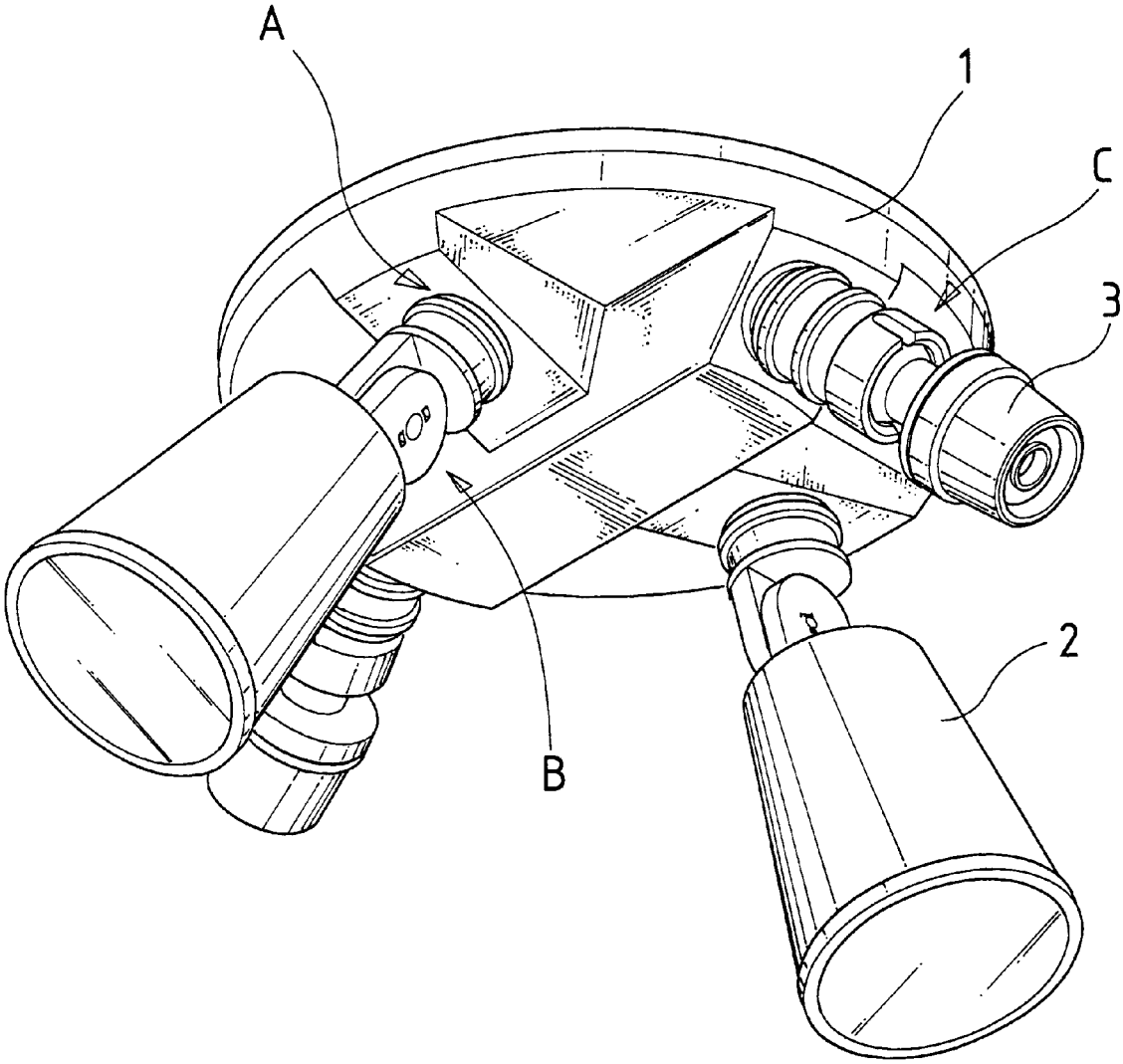
FIG. 2 is a perspective assembled view of the detector of the present invention.
Figure 3:
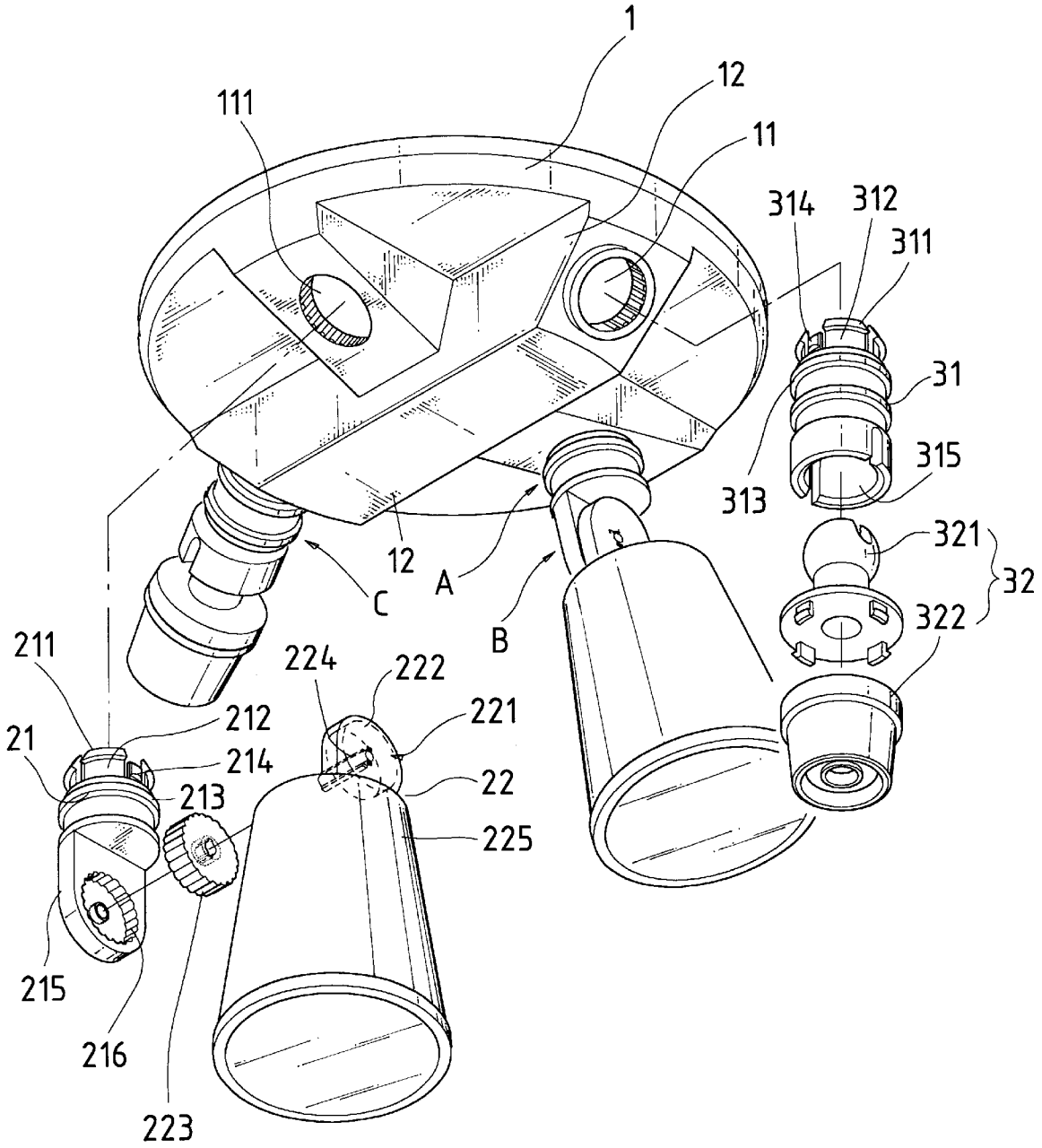
FIG. 3 is a perspective exploded view of the detector of the present invention.

Please refer to FIGS. 2 and 3. The present invention includes a base seat 1, a light shade 2 and a detector head 3. The base seat 1 is formed with at least four perforations 11 for two light shades 2 and two detector heads 3 to spacedly insert in. A bulb (not shown) is installed in the light shade 2. An infrared detector is disposed in the detector head 3 for detecting alien article within the detection range and lighting up the bulb. Each light shade 2 is disposed with two shifting mechanisms A, B (or B'). Each detector head 3 is disposed with two shifting mechanisms A, C for freely changing the operation positions. Therefore, the light shades 2 and the detector heads 3 on the base seat 1 are able to detect in two different directions at the same time to provide a warning and illumination function.

Figure 4:
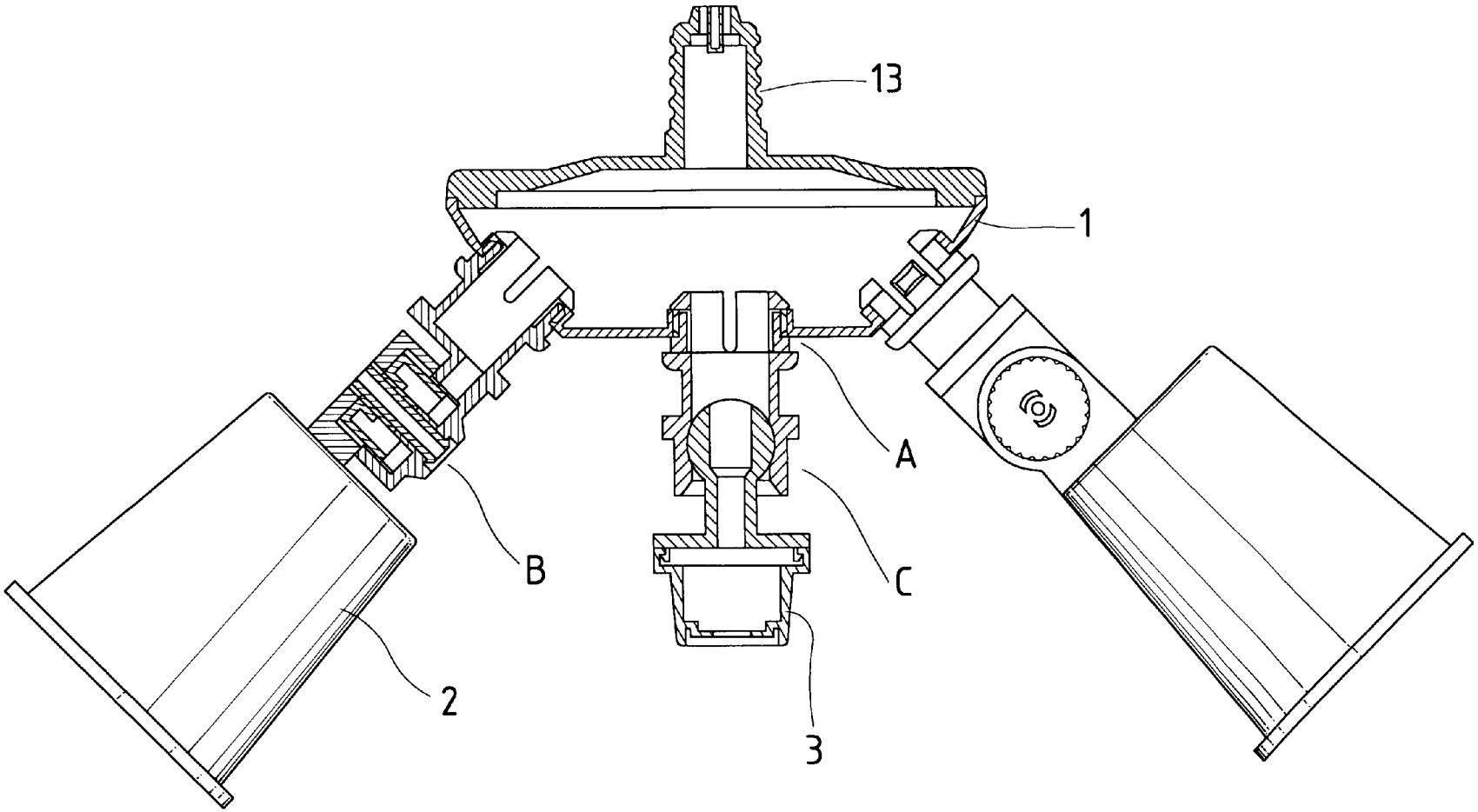
FIG. 4 is a sectional assembled view of the detector of the present invention.

FIGS. 3 and 4 show the details of the present invention. The upper end of the base seat 1 is disposed with an electric connector 13 for directly electrically connecting with a common bulb socket. The lower side of the base seat is formed with a cross-shaped slope faces 12 on which the four perforations 11 are formed. Therefore, the light shades 2 and the detector heads 3 are inclinedly connected with the base seat and substantially oriented in four directions. The inner wall of each perforation 11 is formed with plum blossom-shaped locating teeth 111 for meshing with upper end of the light shade 2 or the detector head 3 to form the shifting mechanism A.

The detector head 3 is composed of a first and a second fitting members 31, 32. The first fitting member 31 is a short tube member one end of which is formed with multiple tenons 312 with oblique step section 311 and locating plates 314 annularly interlaced with each other. A root section thereof is formed with an engaging ring 313. The other end of the fitting member 31 is connected with the second fitting member 32 to form a shifting mechanism C which is a universal joint formed by a socket 315 and a ball post 321 of upper end of the fitting member 32. The other end of the ball post 321 is connected with a short tube 322 in which the infrared detector is disposed.

The light shade 2 is composed of a first and a second pivot members 21, 22. The first pivot member 21 is a short tube one end of which is disposed with multiple spacedly annularly arranged tenons 212. The end is formed with oblique step sections 211 for easily fitting into the perforation 11. A root section thereof is disposed with an engaging ring 213 for locating the pivot member 21. Shorter locating, plates 214 are interlaced with the tenons 212. The locating plates 214 are formed with engaging edges for engaging with the locating teeth 111 in the perforation. In operation, by means of the resilience of the locating plates 214, the light shades are rotated and located at intervals. The other end of the pivot member 21 is connected with the second pivot member 22 to form a shifting mechanism B which is a universal joint composed of two pivot half plates 215, 221 pivotally connected by a pivot shaft 224 and formed with opposite toothed holes 216, 222 and circular toothed block 223. A base section of the half plate 221 is connected with an enlarged cylinder body 225 in which a bulb seat is disposed for fitting with a bulb.

Figure 7:
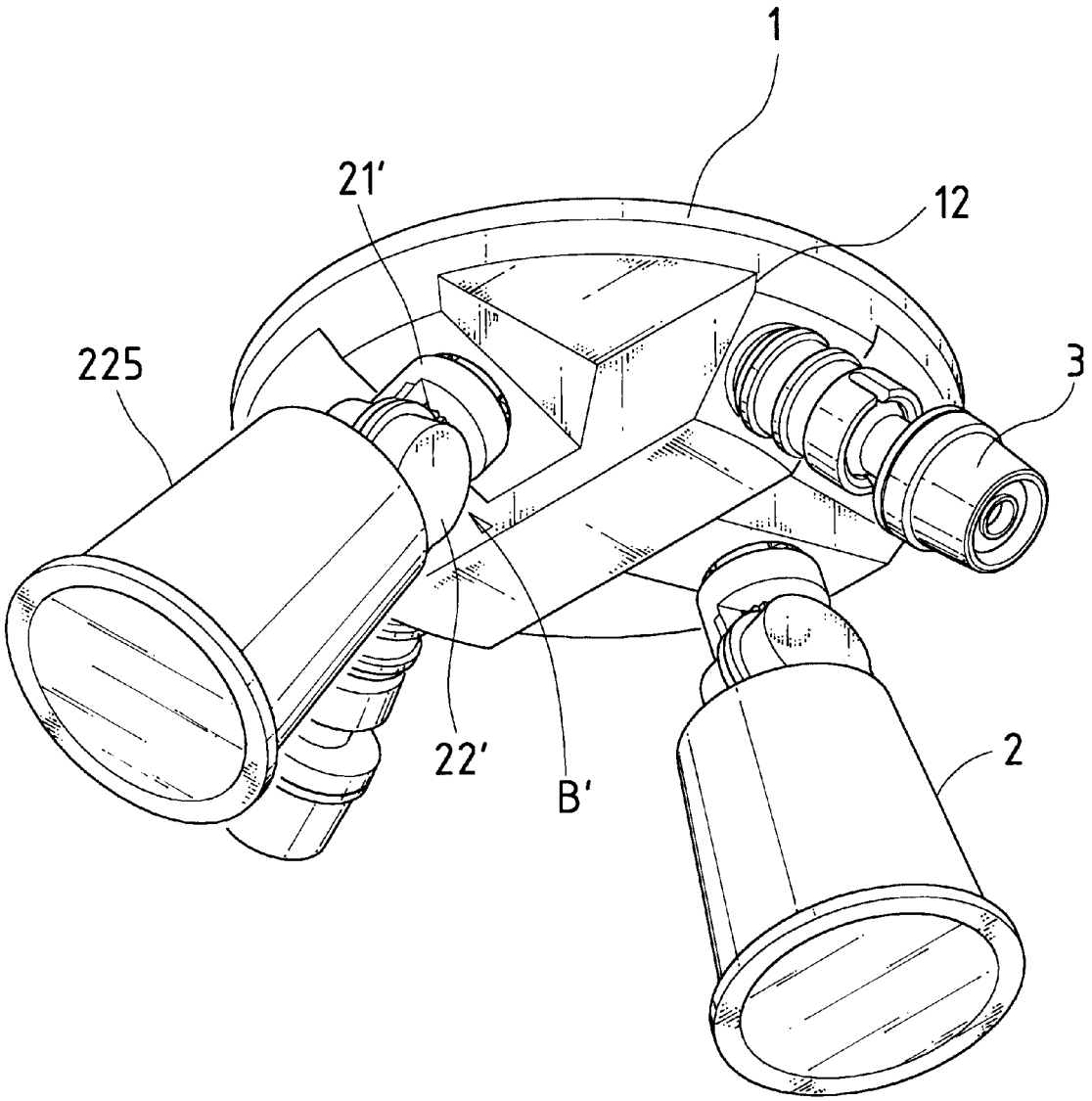
FIG. 7 is a perspective assembled view of another embodiment of the detector of the present invention.
Figure 8:
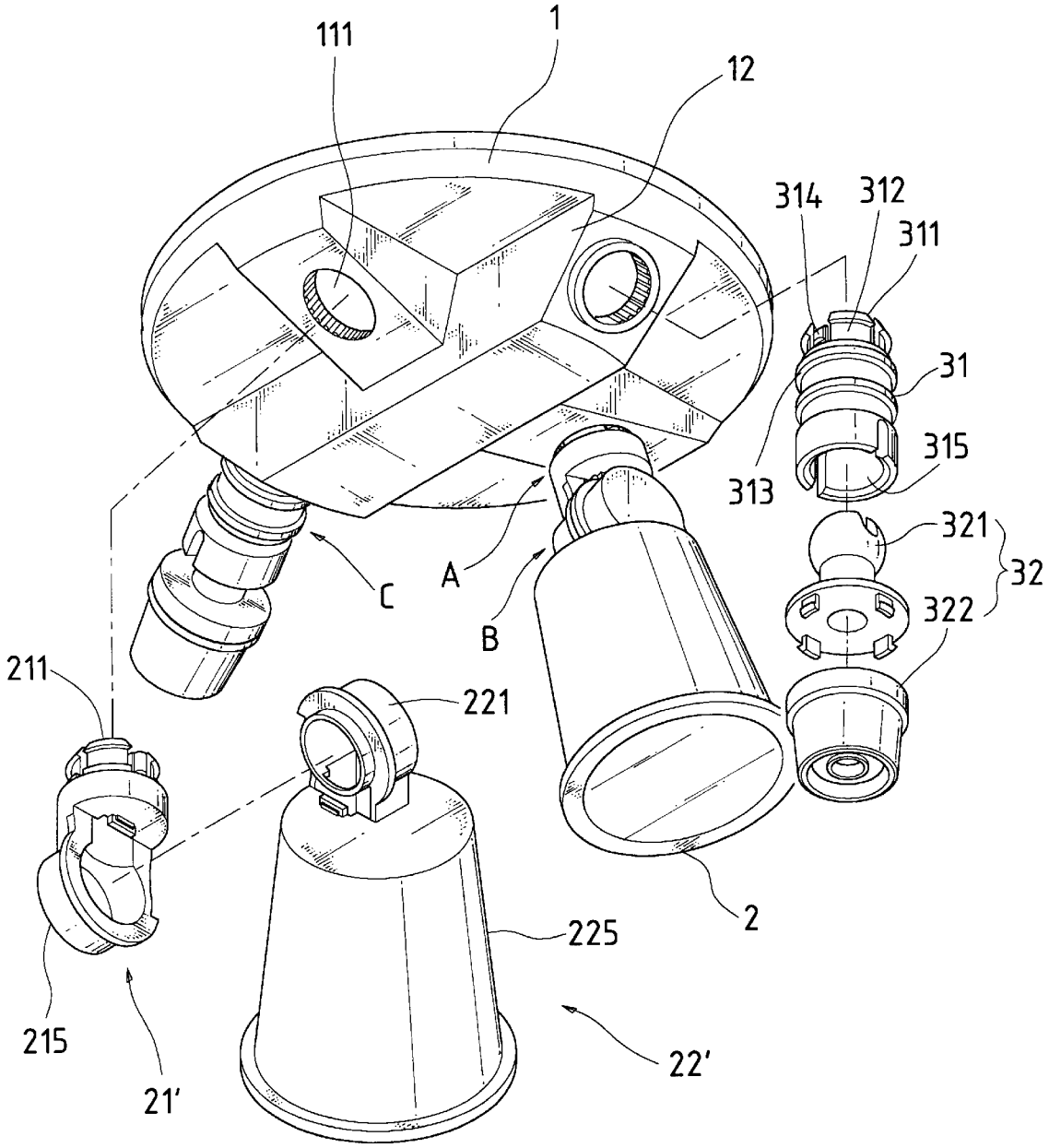
FIG. 8 is a perspective exploded view of the embodiment of FIG. 7.
Figure 9:
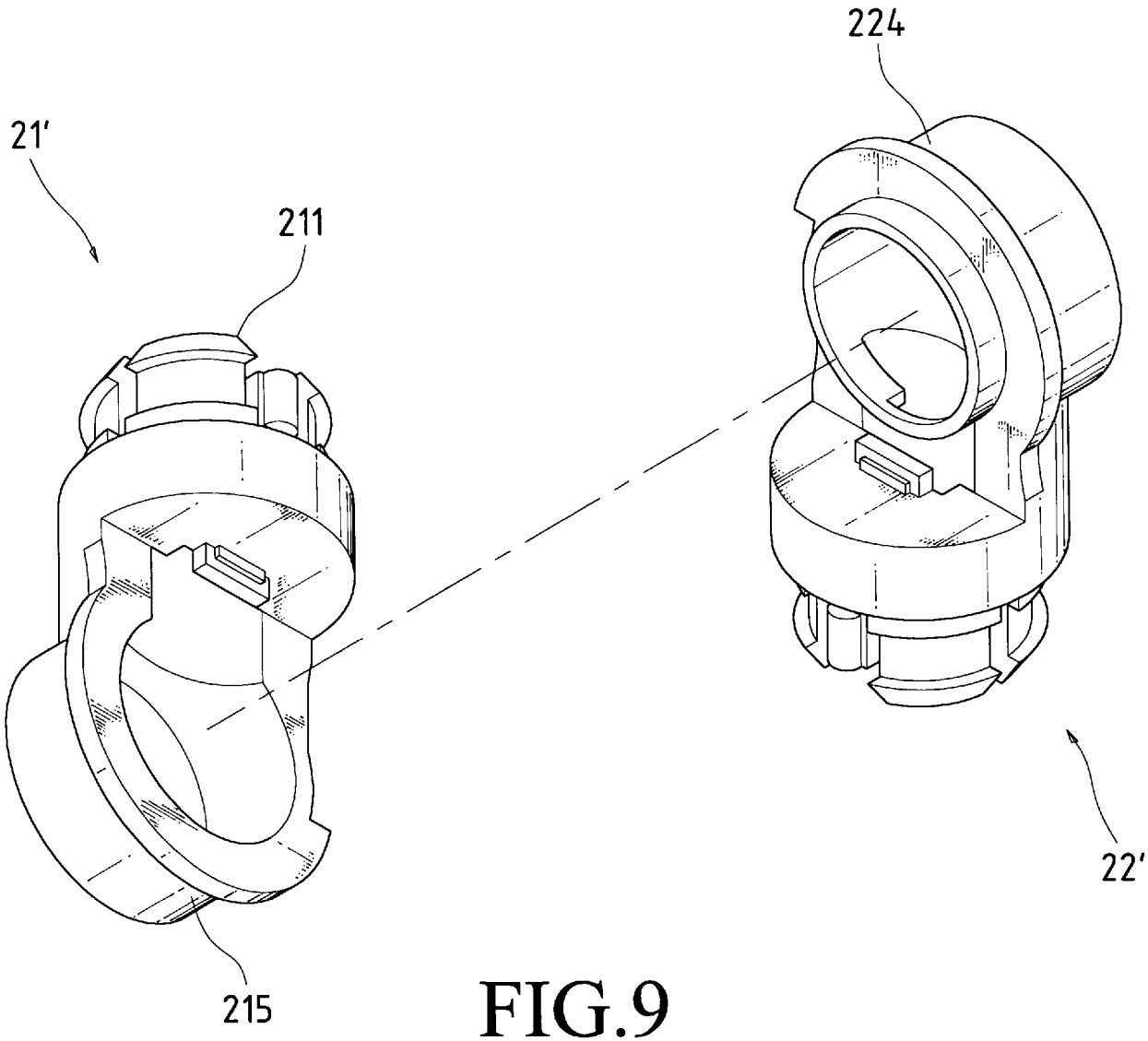
FIG. 9 is a perspective exploded view of the shifting mechanism of the other embodiment.

Alternatively, as shown in FIG. 9, two pivot members 21', 22' can form another shifting mechanism B' without connection by the pivot shaft 224. The edges of the pivot half plates 215, 221 of the first and second pivot members 21', 22' are disposed with projecting plates and the base section thereof is disposed with a vertical face. One side of the projecting plate is formed with a cut. The vertical face is disposed with a projecting block. The height of the projecting block is spaced from the pivot faces of the pivot half plates 215, 221 to define an insertion slot. The pivot face of the second pivot member 22' is disposed with a sleeve. After the projecting blocks of the two pivot members 21', 22' are aligned with the cuts of each other, the sleeve of the pivot member 22' is fitted into the pivot member 21' and then the pivot members 21', 22' are rotated relative to each other, making the projecting plates slided and engaged in the insertion slots of each other to form the shifting mechanism B' (as shown in FIGS. 7 and 8 ) instead of the shifting mechanism B.

Figure 5:
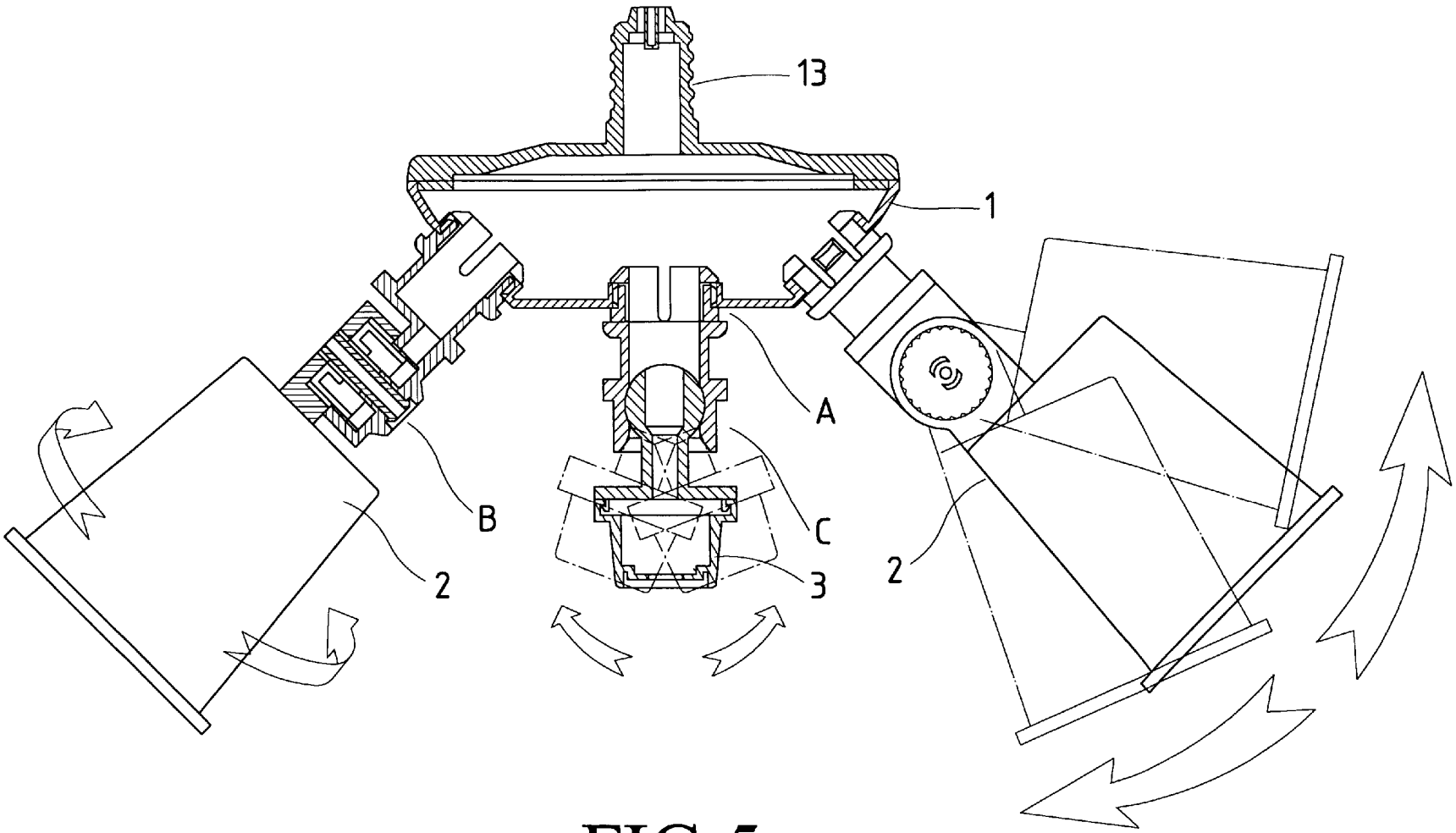
FIG. 5 is a view according to FIG. 4, showing the multi-directional adjustment of detector of the present invention.
Figure 6:
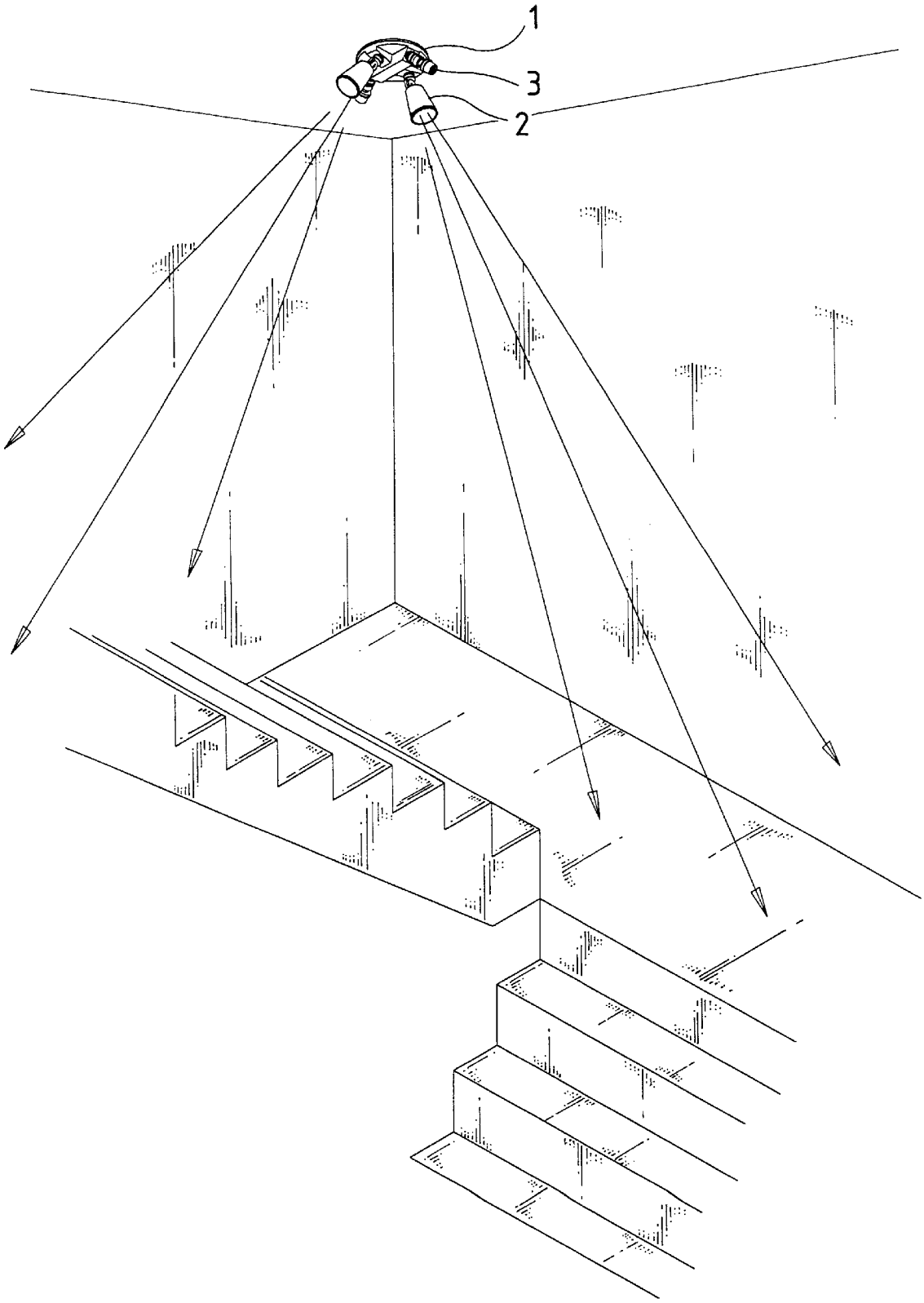
FIG. 6 shows the two-way detection of the detector of the present invention.

Referring to FIGS. 5 and 6, the light shade 2 and the detector head 3 can be multi-directed by means of the shifting mechanisms A, B, (or B'), C so as to achieve an optimal effective detection range. The adjustable detection face reaches 360 degrees. Therefore, when applied to a stairway (or other specific site ), the detector can at the same time detect two ways of the upward stairway or downward stairway to achieve an all-directional detection function.

In application, a simple setting circuit is disposed in the present invention. After the electric connector 13 is connected with a bulb seat, a variable resistor is used to adjust and set up the activation time. In addition, a remote circuit, oscillation circuit and alarm can be added to the detector to expand the function thereof and enable a user to set up and disarm the alarm by remote control.

It should be noted that the above description and accompanying drawings are only used to illustrate some embodiments of the present invention, not intended to limit the scope thereof. Any modification of the embodiments should fall within the scope of the present invention.

What is claimed is:

1. An infrared illuminative warning detector comprising a base scat with at least two light shades and two detector heads, a bulb being installed in each light shade, a detector being disposed in each detector head for detecting an alien article within a detection range and lighting up the bulb, each light shade and detector head being disposed with at least one shifting mechanism for freely changing operation position, whereby the light shades and the detector heads on the base are able to detect in two different directions at the same time to provide a two-way warning and illumination function, wherein an upper side of the base seat has an electric connector for directly electrically connecting with a bulb socket, a shifting mechanism for the light shade being comprised of a first and a second pivot member, the first pivot member being a short tube, one end of which is disposed with multiple, spaced annularly arranged tenons having oblique step sections, a root section thereof being disposed with an engaging ring, and a joint for connecting with the second pivot member, the joint being composed of two pivot half plates pivotally connected by a pivot shaft and formed with opposite toothed holes and a toothed block, a base section of the half plate of the second pivot member being connected with an enlarged cylinder body in which a bulb seat is disposed for fitting with a bulb, the detector head being comprised of a first and a second fitting member, the first fitting member being a short tube member one end of which is formed with multiple annularly arranged tenons with oblique step sections, a root section thereof being formed with an engaging ring, the shifting mechanism disposed at the other end of the first fitting member being a universal joint formed by a socket and a ball post of upper end of the second fitting member, the other end of the ball post being connected with a short tube in which the infrared detector is disposed.

2. The infrared illuminative warning detector as claimed in claim 1, wherein the face of the base seat has cross-shaped sloped faces on which four perforations are formed, the perforations being disposed with the shifting mechanisms for connecting with the light shade and the detector head, each shifting mechanism including locating teeth formed on an inner wall of the perforation and shorter locating plates interlaced with the tenons of the light shade and detector head, the locating plates being formed with engaging edges for engaging with the locating teeth in the perforation.

3. The infrared illuminative warning detector as claimed in claim 1, further comprising a setting circuit disposed in the detector for setting an activation time thereof.

4. The infrared illuminative warning detector as claimed in claim 1, further comprising a remote control circuit and an alarm disposed in the detector to set up and disarm the alarm by remote control.

5. An infrared illuminative warning detector comprising a base seat formed with at least two light shades and two detector heads, a bulb being installed in each light shade, a detector being disposed in each detector head for detecting an alien article within a detection range and lighting up the bulb, each light shade and detector head being disposed with at least one shifting mechanism for freely changing operation position, whereby the light shades and the detector heads on the base are able to detect in two different directions at the same time to provide a two-way warning and illumination function, wherein the shifting mechanism disposed on the light shade comprises a first and a second pivot member comprising pivot half plates, the edge of the pivot half plates of the first pivot member being disposed with projecting plates and a base section thereof being disposed with a projecting block, a height of the projecting block being such as to define thereunder a first insertion slot, the second pivot member being also disposed with a projecting plate and projecting block defining thereunder a second insertion slot, the pivot face of the second pivot member being additionally disposed with a sleeve for fitting with the first pivot member.

6. The infrared illuminative warning detector as claimed in claim 5, wherein the face of the base seat has cross-shaped sloped faces on which four perforations are formed, the perforations being disposed with the shifting mechanisms for connecting with the light shade and the detector head, each shifting mechanism including locating teeth formed on an inner wall of the perforation and shorter locating plates interlaced with the tenons of the light shade and detector head, the locating plates being formed with engaging edges for engaging with the locating teeth in the perforation.

7. The infrared illuminative warning detector as claimed in claim 5, further comprising setting circuit disposed in the detector for setting the activation time thereof.

8. The infrared illuminative warning detector as claimed in claim 5, further comprising a remote control circuit and an alarm disposed in the detector to set up and disarm the alarm by remote control.

* * * * *